US007690306B1

(12) United States Patent
King

(10) Patent No.: US 7,690,306 B1
(45) Date of Patent: Apr. 6, 2010

(54) USE OF BARITE IN PERFORATING DEVICES

(75) Inventor: Allan W. King, Manvel, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/326,617

(22) Filed: Dec. 2, 2008

(51) Int. Cl.
*E21B 43/118* (2006.01)

(52) U.S. Cl. ..... 102/306

(58) Field of Classification Search ..... 89/1.151; 102/307
See application file for complete search history.

(56) References Cited

U.S. PATENT DOCUMENTS 3,777,663 A * 12/1973 Brown ..... 102/331
4,338,713 A * 7/1982 Christopher ..... 419/11
5,098,487 A * 3/1992 Brauer et al. ..... 148/432
5,837,925 A * 11/1998 Nice ..... 102/310
6,371,219 B1 * 4/2002 Collins et al. ..... 175/2
6,530,326 B1 * 3/2003 Wendt et al. ..... 102/306
6,925,924 B2 * 8/2005 Baker et al. ..... 89/1.151
7,581,498 B2 * 9/2009 Hetz et al. ..... 102/306

OTHER PUBLICATIONS

King, Allan W., pending U.S. Appl. No. 12/330,619, filed Dec. 9, 2008 entitled "Shaped Charge With an Integral Liner and Case".
King, Allan W., pending U.S. Appl. No. 12/332,834, filed Dec. 11, 2008 entitled "Use of Barite and Carbon Fibers in Perforating Devices".

* cited by examiner

*Primary Examiner*—Michael Carone
*Assistant Examiner*—Reginald Tillman, Jr.
(74) *Attorney, Agent, or Firm*—Andrus, Sceales, Stare & Sawall, LLP; Kevin B. McGoff; Rodney V. Warfford

(57) ABSTRACT

Disclosed are barite compositions. The barite compositions may be utilized for manufacturing perforator devices, including casing and liner components.

27 Claims, 3 Drawing Sheets

USE OF BARITE IN PERFORATING DEVICES

BACKGROUND

The present invention relates generally to compositions that include barite and the use thereof in perforating devices.

Perforating devices are often used to complete oil and natural gas wells. Typically, a perforating device having an array of perforators is lowered downhole into the well in a perforating gun. When the gun is at the correct depth in the well, the perforators are fired, sending shaped charge jets outward through the side of the gun, through the fluid between the gun and the well casing, through the well casing, and finally into the oil-bearing or natural-gas bearing rock. The resulting holes in the well casing allow oil or natural gas to flow into the well and to the surface. The remains of the perforating device must then be withdrawn from the well after the perforators have been fired. Perforating device technology is disclosed in the art. (See, e.g., U.S. Pat. Nos. 6,349,649; and 6,386,109, which are incorporated by reference in their entireties).

Perforators are used in large numbers every year, and therefore material cost and manufacturing cost are very important factors. A shaped charge perforator can include a liner, a case to contain the liner, a high explosive, and some mechanism to initiate the detonation of the explosive. Typical materials for the case include steel or zinc. Typical liner materials include wrought materials such as copper, zinc and various alloys or pressed powder including a mixture of copper, lead and tungsten.

SUMMARY

Disclosed are compositions that include barite and the use thereof for manufacturing components of perforating devices for use in completing a well. In some embodiments, the perforating device includes the following components: (a) a casing; (b) an explosive charge; and (c) a shaped liner enclosing the explosive charge in the casing, where at least one of the shaped liner and the casing includes barite. In further embodiments, both the shaped liner and the casing include barite.

At least one of the components of the perforating device includes barite (e.g., a liner or casing that includes barite). Optionally, the component further may include metal or steel (i.e., an alloy comprising mostly iron and having a carbon content of between 0.2% and 2.04% by weight, depending on grade). The barite may be barite powder and the metal or steel may be metal powder or steel powder.

The component that includes barite and optionally metal or steel further may include a binder. In some embodiments, the component is formed from barite powder and (optionally metal or steel powder) that is mixed with a binder. The binder may be powder. The binder further may be a polymeric material or wax. The binder may be a curable binder such as a curable epoxy powder or thermosetting epoxy resin. In further embodiments, the binder may be flash-cured or sintered.

The component (e.g., a casing) preferably includes a sufficient amount of barite to achieve a desirable result. In some embodiments, the component includes a sufficient amount of barite so that the component disintegrates into a powder upon detonation of the explosive charge of the device. Preferably, the powder attenuates shock caused by detonation of the explosive charge.

In some embodiments, the component includes at least about 25% barite, with the remainder of the component being steel and a binder. In further embodiments, the component includes at least about 30% barite, with the remainder of the component being steel and a binder. In even further embodiments, the component includes at least about 70% barite, with the remainder of the component being steel and a binder.

Preferably, the component that includes barite has a density that is suitable for use in a perforating device. In some embodiments, the component has a density within the range of about 3.0-7.5 grams/cc.

Also disclosed are methods for making perforating devices for use in completing a well or components of perforating devices. The methods may include: (a) providing an explosive charge; (b) forming at least one component such as a casing or a liner out of a material that includes barite; and (c) enclosing the explosive charge between the casing or the liner. In some embodiments, both the casing and the liner are formed from a material that includes barite (e.g., barite powder). Optionally, the material may further include metal or steel (e.g., metal powder or steel powder) and a binder (e.g., a binder powder). Preferably, the material includes at least about 25% barite, with the remainder being steel and a binder, and the material has a density in the range of about 3.0-7.5 grams/cc.

The component may be formed pressing the barite material into a forming mold. Furthermore, the component may be heated (e.g., to a temperature of about 300-400° F.) in the mold. Subsequently, the component may be cooled to room temperature.

Also disclosed are barite compositions. The compositions may include (a) barite (e.g., barite powder); (b) metal or steel (e.g., metal powder or steel powder); and (c) a binder (e.g., a binder powder). Preferably, the composition has a density within a range of 3.0-7.5 grams/cc. In some embodiments, the composition includes at least about 25% barite (w/w) (or at least about 30% barite (w/w), or at least about 70% barite (w/w)). The remainder of the composition may include metal or steel and binder (e.g., an epoxy powder, an epoxide resin, a polymeric material, a wax, or a lubricant such as tin material). The composition may be utilized for forming one or more components of a perforating device (e.g., a casing or a liner).

BRIEF DESCRIPTION OF THE DRAWINGS

The best mode of carrying out the invention is described with reference to the following drawing figures.

DETAILED DESCRIPTION

Figure 1:
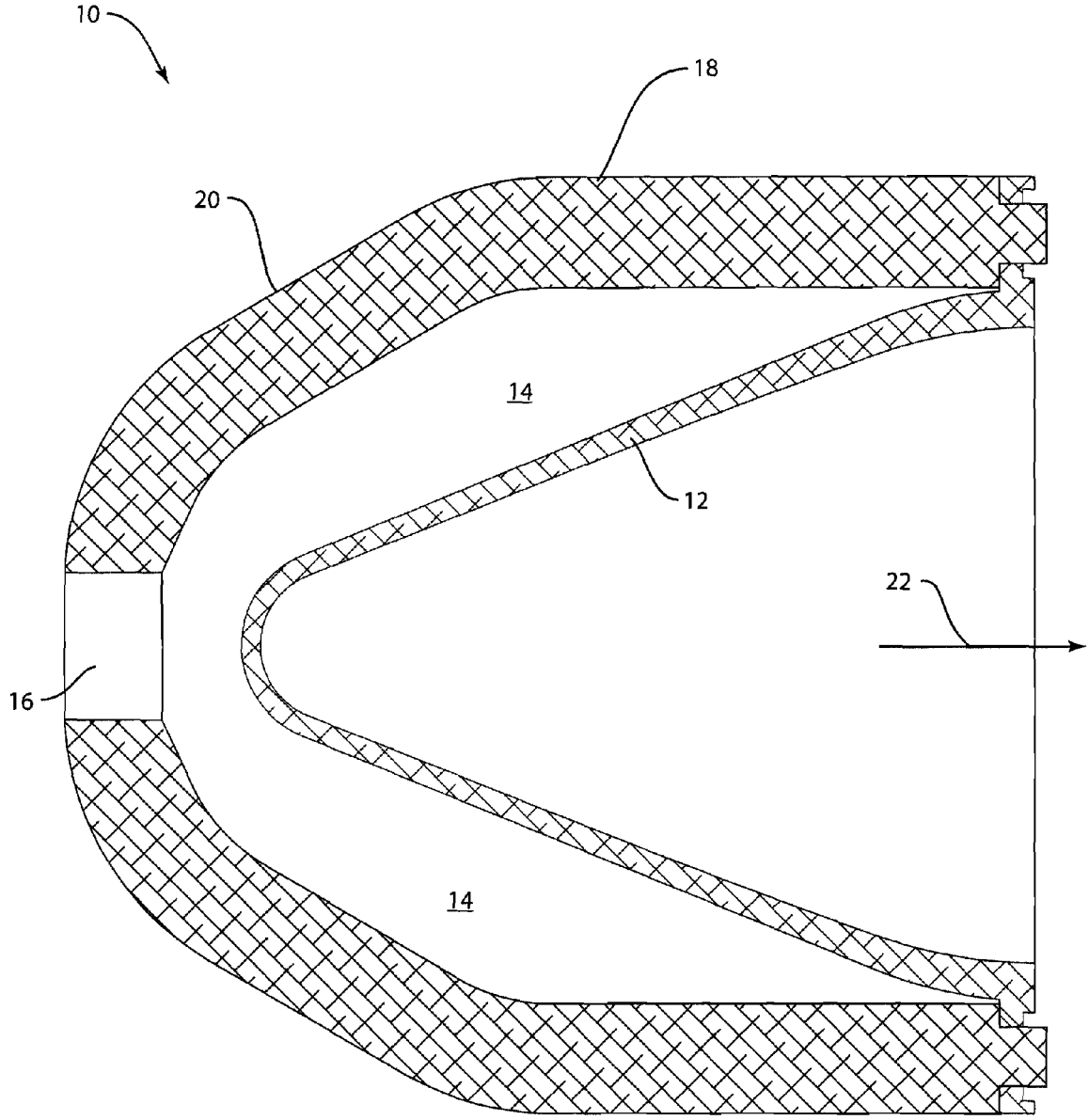
FIG. 1 is a sectional view of a shaped charge perforator.

The disclosed subject matter is further described below.

Unless otherwise specified or indicated by context, the terms "a", "an", and "the" mean "one or more."

As used herein, "about", "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus ≦10% of the particular term and "substantially" and "significantly" will mean plus or minus >10% of the particular term.

As used herein, the terms "include" and "including" have the same meaning as the terms "comprise" and "comprising."

Barite, otherwise called "baryte" or "$BaSO_4$" is the mineral barium sulfate. It generally is white or colorless and is a source of barium. It has a Moh hardness of about 3, a refractive index of about 1.63, and a specific gravity of about 4.3-5.0. Barite may be ground to a small, uniform size (i.e., barite powder) and may be used as a filler or extender in industrial products, or as a weighting agent in petroleum well drilling mud.

Steel, is a mixture or alloy that includes mainly iron, with a carbon content between 0.2% and 2.04% by weight, depending on grade. Carbon is the most cost-effective alloying material for iron, but various other alloying or nodularizing elements may be used such as manganese, chromium, vanadium, tungsten, tin, copper, lead, silicon, nickel, magnesium.

As disclosed herein, barite has been identified as a substitute material for steel which is utilized for manufacturing components of perforators used in oil and gas bearing formations. These perforator components in which barite is used as a replacement material include shaped casings and shaped liners for charges. Barite has a density that is about ⅔ that of steel. Surprisingly, this reduction in density was not observed to materially affect the perforator's performance with respect to penetration or hole size when barite was used as a replacement for steel in casings and liners. In addition, perforator components that comprise barite were observed to disintegrate into powder upon detonation of the explosive within the perforator, thereby minimizing damage to the gun and reducing debris within the wellbore. Furthermore, because barite has a sufficient density and because barite has the ability to form powder jets, material comprising barite can be used to form shaped charge liners.

The perforator components disclosed herein (e.g., case components and/or liner components) comprise barite. In some embodiments, the components comprise at least about 25%, 30%, 40%, 45%, 50%, 55%, 60%, 65%, 70%, 75%, 80%, 85%, 90%, 95%, or 98% (w/w) barite. The remainder may comprise a binder (e.g., at least about 1%, 2%, 5%, 10%, 20% (w/w), or greater). The remainder may comprise a metal or metal alloy such as steel (e.g., at least about 1%, 2%, 5%, 10%, 15%, 20%, 25%, 30%, 35%, 40%, 45%, 50%, 55%, 60%, 65%, 70%, 75% (w/w), or greater). The barite, binder, metal (or metal alloy) may be in the form of a powder which is subsequently heat-treated or otherwise cured.

Powder metallurgy and the use of powdered materials and binders for forming shaped articles are known in the art. (See, e.g., U.S. Pat. No. 6,048,379, which is incorporated by reference in its entirety.) Shaped components or perforators (e.g., casings and liners) can be prepared by forming a mixture comprising barite (e.g., barite powder), metal or steel (e.g., metal powder or steel powder), and a binder. Suitable binders will hold together particles of the barite powder and particles of the metal or steel powder. Suitable barite for use in the shaped components disclosed herein may include glassmaker barite. Suitable barite products also are available from Mi-Swaco Corporation. The mixture thus formed may be pressed into a mold to form the shaped component in green form. The shaped component then may be heated to a sufficient temperature for flash-curing. Subsequently, the shaped component may be cooled to room temperature and assembled in a perforator gun.

Binders for powder metallurgy are known in the art. (See, e.g., U.S. Pat. Nos. 6,008,281; 7,074,254; and 7,384,446, which are incorporated by reference herein in their entireties). Preferred binders as contemplated herein may include, but are not limited to, epoxy powder (e.g. Scotchkote® Brand Fusion Bonded Epoxy Powder such as 226N+ epoxy powder, available from 3M Corporation) and thermosetting epoxy resin (e.g., Scotchcast 265 thermosetting epoxy resin, also available from 3M Corporation). Suitable binders may include polyurethane resin or polyester resin. Thermosetting resins are known in the art. (See, e.g., U.S. Pat. No. 5,739,184, which is incorporated by reference herein in its entirety.) Other suitable binders include waxes and polymeric binders. (See, e.g., U.S. Pat. No. 6,048,379, which is incorporated by reference herein in its entirety). In some embodiments, the compositions include a lubricant (e.g., tin) or a release agent (e.g., a salt of a fatty acid such as zinc stearate).

The shaped components as disclosed herein for use in perforators may include metal or steel. For example, the shaped components or perforators may be formed from a mixture that comprises barite, steel (e.g., Ancorsteel 1000 or 1000B brand powdered steel available from Hoeganese Corporation), and a binder.

FIG. 1 shows an example of a shaped charge perforator 10 for use in an oil and gas well. The perforator 10 has a liner 12 and an explosive charge 14 contained in a case 18. A detonating cord (not shown) may be positioned in an opening 16 located generally at the rear of the case 18. The outer surface 20 of the case 14 may be formed to fit into a holding apparatus inside a perforating gun (not shown). The particular size and shape of the exemplary perforator 10 and its components can vary greatly, as known in the art. It should be recognized that the concepts of the invention claimed herein are not limited to the particular structures shown in FIG. 1.

In use, the shaped charge perforator 10 is lowered into the well in a perforating gun. When the gun is at the correct depth in the well, the explosive charge 14 is ignited via the detonating cord (not shown). Explosion of the charge shapes the liner into a jet, which is propelled outward in the direction of arrow 22, through the side of the gun, through the fluid between the gun and the well casing, through the well casing, and finally into the oil-bearing or natural-gas bearing rock. The resulting holes in the well casing allow oil or natural gas to flow into the well and to the surface.

Figure 2:
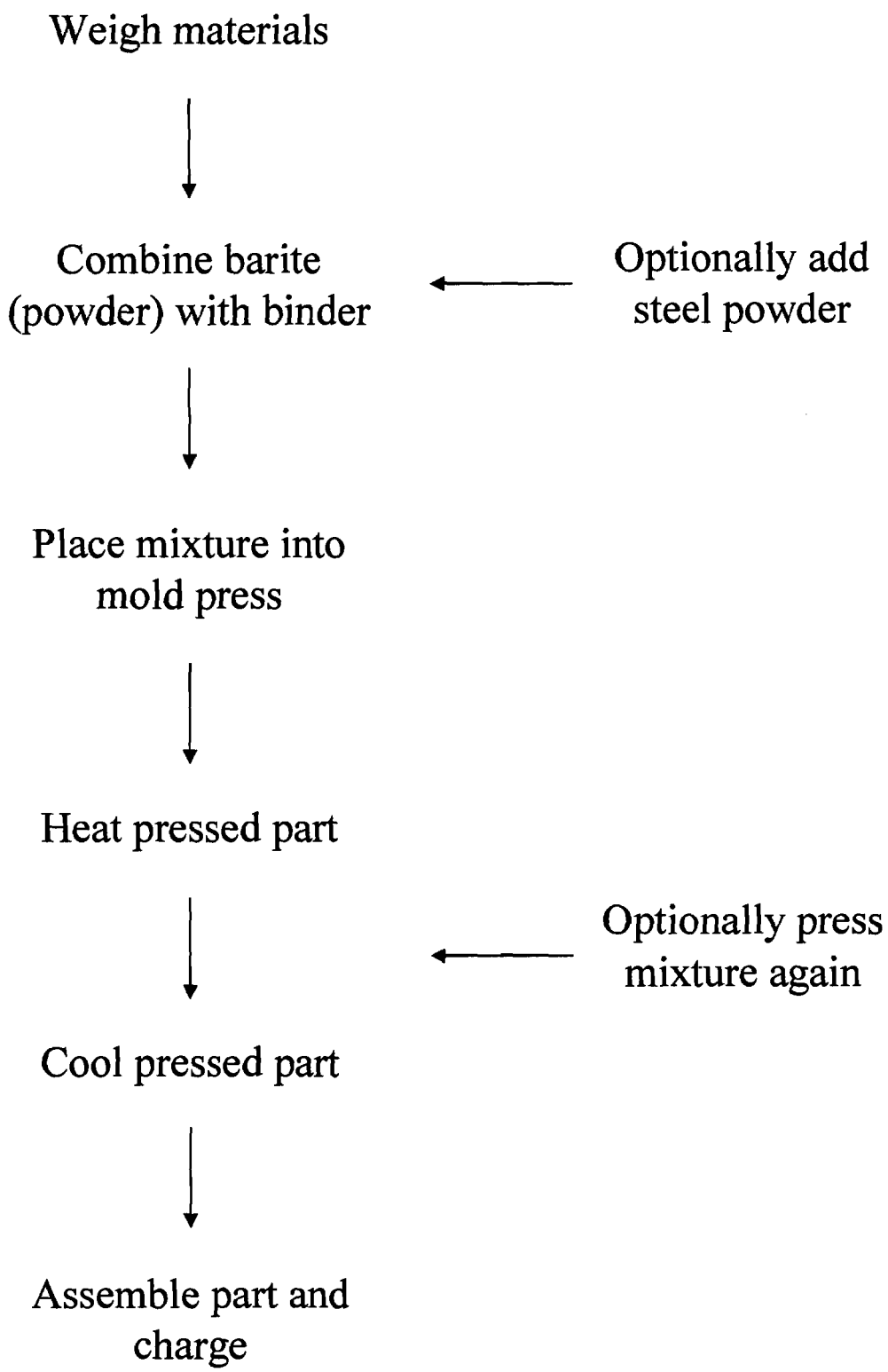
FIG. 2 is a flow chart showing one example of a method of making a perforator.

Referring to FIG. 2, compositions comprising barite, a binder, and optionally steel powder may be combined to form a mixture. The mixture may then be pressed in a mold to provide a green form of a case or liner part. Subsequently, the part is heated to a sufficient temperature to cure the binder (e.g., to a temperature of about 300-400° F.). Optionally, the heated part may be pressed again in the same mold or a different mold. The heated part then may be rapidly cooled and subsequently assembled. For example, a shaped case and liner may be assembled to enclose an explosive charge. The assembled part subsequently may be further assembled in a perforator.

In some embodiments, the composition for forming a case or liner part may include a release agent to facilitate release of the part from a mold. Suitable release agents may include salts of fatty acids (e.g., zinc stearate).

In further embodiments, the case or liner part may be formed by placing a composition comprising barite and steel powder in a mold and applying sufficient tonnage in a forming process to obviate the need for the use of a binder. For example, the case or liner part may be formed from a composition that doe not comprise resin.

Figure 3:
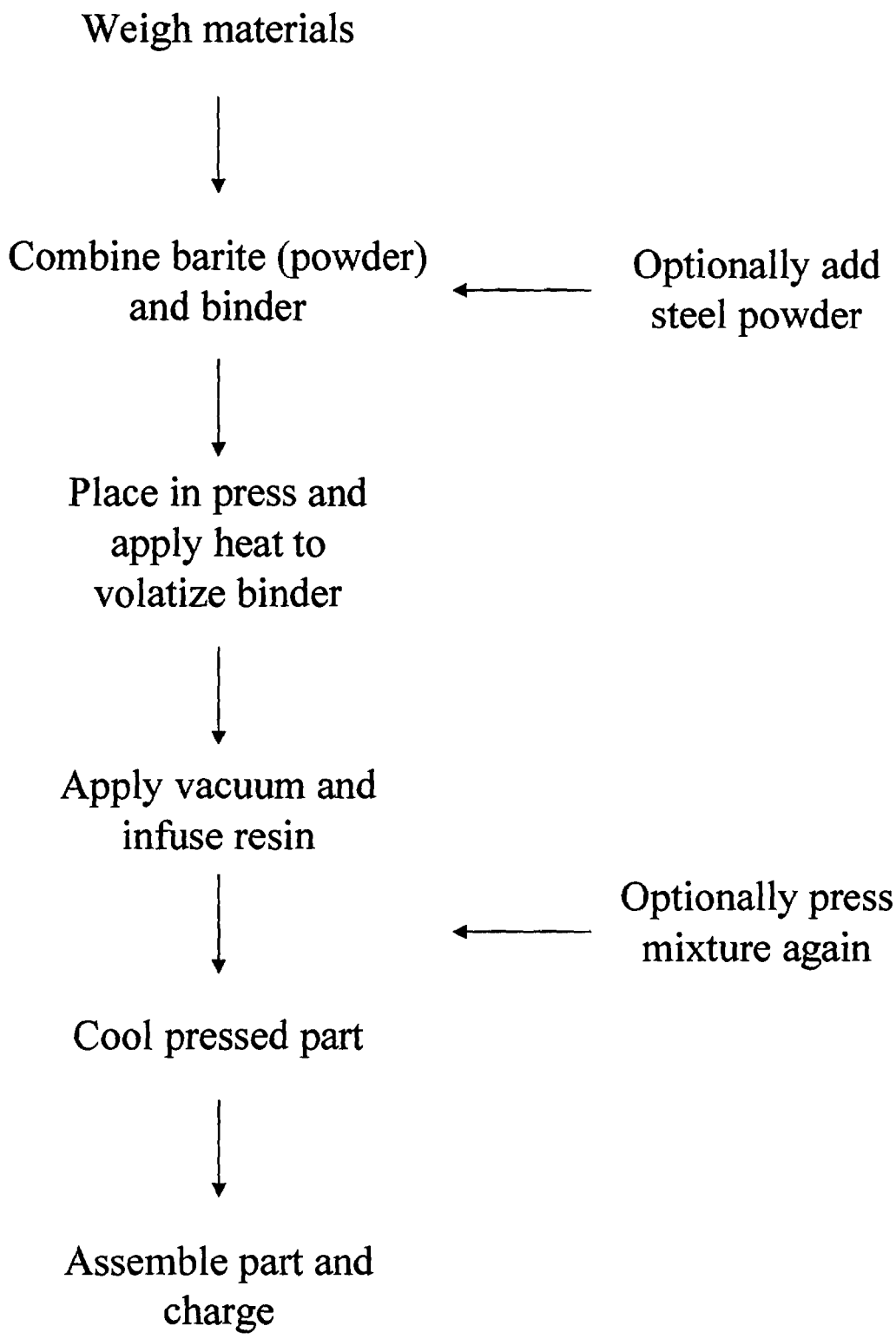
FIG. 3 is a flow chart showing another example of a method of making a perforator.

Referring to FIG. 3, compositions comprising barite and a binder (e.g., wax or a polymeric binder) may be prepared and pressed into the shape of a case or a liner in a mechanical or hydraulic press. Heat may then be applied to the shaped case or liner which is sufficient to volatize the binder and create a porous barite matrix. A vacuum is applied to the shaped case or liner, at which point resin is infused into the shaped case or liner and allowed to cure. The resin infuses into the porous barite matrix, forming a hard, resilient, and machinable case or liner. In other embodiments, barite can be formed into a ceramic paste or matrix which is molded into shape, processed, and heated in the same manner as ceramics (e.g., porcelain parts, bearings, and utensils). Optionally, the heated part may be pressed again in the same mold or a different mold. The heated part then may be rapidly cooled and subsequently assembled. For example, a shaped case and liner may be assembled to enclose an explosive charge. The assembled part subsequently may be further assembled in a perforator.

Perforating devices were prepared as indicated in Table 1.

TABLE 1

| Test Device | Case Size | Case Material | Case Weight gms | Case Density gm/cc | Liner | Liner Material | Liner Weight gms | Density gm/cc |
|---|---|---|---|---|---|---|---|---|
| 1 | 2506 | Steel | 101 | 7.3 | 31 mm | 80/20 Cu/Pb | 14 | 8.4 |
| 2 | HEGS 3 1/8 | 70/30 Barite/Steel | 67 | 3.3 | 31 mm | 80/20 Cu/Pb | 14 | 8.4 |
| 3 | HEGS 3 1/8 | 70/30 Barite/Steel | 67 | 3.3 | 31 mm | 64/30/6 Steel/Cu/Pb | 15 | 7.69 |
| 4 | 38-08 | 25/75 Barite/Steel | 140 | 4.7 | 38 mm | 64/16/14/6 Steel/Sn/Cu/Pb | 28 | 7.6 |
| 5 | 38-08 | Steel | 230 | 7.3 | 38 mm | Cu/Pb 80/20 | 28 | 8.13 |

Test devices 2, 3, and 4 included barite as part of the case material. The perforating devices were detonated and various performance parameters were assessed, including explosive weight, penetration distance, gun hole diameter, and casing hole diameter. Results are presented in Table 2.

TABLE 2

| Test Device | Density gm/cc | Explosive Type | Expl. Wt. gms | Penetration (In) | Gun Hole (In) | Casing Hole (In) |
|---|---|---|---|---|---|---|
| 1 | 8.4 | RDX | 10.5 | 13.4 | 0.42 | 0.4 |
| 2 | 8.4 | RDX | 10.5 | 11.6 | 0.5 | 0.3 |
| 3 | 7.69 | RDX | 10.5 | 12 | 0.49 | 0.34 |
| 4 | 7.6 | RDX | 26 | 20 | 0.41 | 0.46 |
| 5 | 8.13 | RDX | 26 | 21.1 | 0.51 | 0.54 |

In the following description, certain terms have been used for brevity, clearness, and understanding. No unnecessary limitations are to be implied therefrom beyond the requirement of the prior art because such terms are used for descriptive purposes only and are intended to be broadly construed. The different apparatuses and method steps described herein may be used alone or in combination with other apparatuses and method steps. It is to be expected that various equivalents, alternatives and modifications are possible within the scope of the appended claims.

What is claimed is:

1. A perforating device for use in completing a well, comprising:

(a) a casing;

(b) an explosive charge; and (c) a shaped liner enclosing the explosive charge in the casing;

wherein at least one of the shaped liner and the casing comprises a composition of barite and metal.

2. The perforating device according to claim 1, wherein both the shaped liner and the casing comprise a composition of barite and metal.

3. The perforating device according to claim 1, wherein at least one of the shaped liner and the casing further comprises steel.

4. The perforating device according to claim 1, wherein the casing comprises a sufficient amount of barite so that the casing disintegrates into a powder upon detonation of the explosive charge.

5. The perforating device according to claim 4, wherein the powder attenuates shock caused by detonation of the explosive charge.

6. The perforating device according to claim 1, wherein at least one of the shaped liner and the casing further comprises a binder.

7. The perforating device according to claim 6, wherein the binder is a cured epoxy powder.

8. The perforating device according to claim 6, wherein the binder is a thermoset epoxy resin.

9. The perforating device according to claim 6, wherein the binder is a polymeric material.

10. The perforating device according to claim 6, wherein the binder is a wax.

11. The perforating device according to claim 6, wherein the liner comprises tin material.

12. The perforating device according to claim 6, wherein the binder is flash-cured.

13. The perforating device according to claim 6, wherein the binder is sintered.

14. The perforating device according to claim 1, comprising at least about 25% barite, remainder steel and a binder.

15. The perforating device according to claim 1, comprising at least about 30% barite, remainder steel and a binder.

16. The perforating device according to claim 1, comprising at least about 70% barite, remainder steel and a binder.

17. The perforating device according to claim 1, wherein the at least one of the shaped liner and the casing further comprising barite has a density of about 3.0-7.5 grams/cc.

18. A method of making a perforating device for use in completing a well, comprising:

(a) providing an explosive charge;

(b) forming at least one of a casing and a liner out of a material that comprises a composition of barite and metal; and (c) enclosing the explosive charge between at least one of the casing and the liner.

19. The method of claim 18, comprising the step of forming both the casing and the liner out of a material that comprises a composition of barite and metal.

20. The method of claim 18, wherein the material further comprises steel.

21. The method of claim 18, wherein the material comprises at least about 25% barite, the remainder comprising steel and a binder.

22. The method of claim 18, wherein the material has a density in the range of 3.0-7.5 grams/cc.

23. The method of claim 18, wherein the material further comprises a binder.

24. The method of claim 18, wherein forming comprises the step of pressing the material into a forming mold to form at least one of the casing and the liner.

25. The method of claim 24, wherein forming further comprises the step of heating the mold to a temperature of about 300-400° F. in the mold.

26. The method of claim 25, wherein forming further comprises the step of cooling the mold to room temperature.

27. A perforating device for use in completing a well, comprising:

(a) a casing;

(b) an explosive charge; and (c) a shaped liner enclosing the explosive charge in the casing;

wherein at least one of the shaped liner and the casing comprises a composition of:

(a) barite;

(b) steel; and (c) a binder;

wherein the composition has a density within a range of 3.0-7.5 grams/cc.

* * * * *